US007053848B2

(12) United States Patent
Shoji et al.

(10) Patent No.: US 7,053,848 B2
(45) Date of Patent: May 30, 2006

(54) ANTENNA DEVICE AND PORTABLE RADIO COMMUNICATION TERMINAL

(75) Inventors: Hideaki Shoji, Chiba (JP); Yoshiki Kanayama, Saitama (JP); Masatoshi Sawamura, Saitama (JP)

(73) Assignee: Sony Ericsson Mobile Communications Japan, Inc., Tokyo (JP)

( * ) Notice: Subject to any disclaimer, the term of this patent is extended or adjusted under 35 U.S.C. 154(b) by 106 days.

(21) Appl. No.: 10/489,898

(22) PCT Filed: Jul. 9, 2003

(86) PCT No.: PCT/JP03/08693

§ 371 (c)(1),
(2), (4) Date: Mar. 17, 2004

(87) PCT Pub. No.: WO2004/010533

PCT Pub. Date: Jan. 29, 2004

(65) Prior Publication Data

US 2004/0239575 A1 Dec. 2, 2004

(30) Foreign Application Priority Data

Jul. 19, 2002 (JP) ..... 2002-210557

(51) Int. Cl.
*H01Q 13/10* (2006.01)

(52) U.S. Cl. ..... 343/770; 343/702

(58) Field of Classification Search ..... 343/702, 343/767, 770, 863, 908

See application file for complete search history.

(56) References Cited

U.S. PATENT DOCUMENTS

| | | | | |
|---|---|---|---|---|
| 2,781,512 | A | 2/1957 | Robinson, Jr. | 343/708 |
| 5,220,330 | A | 6/1993 | Salvail et al. | |
| 5,600,337 | A | 2/1997 | Cassel | 343/770 |
| 6,043,786 | A | 3/2000 | Vannatta et al. | 343/770 |
| 6,424,300 | B1 * | 7/2002 | Sanford et al. | 343/702 |
| 6,448,933 | B1 * | 9/2002 | Hill et al. | 343/702 |
| 6,879,849 | B1 * | 4/2005 | Begic | 455/575.7 |

FOREIGN PATENT DOCUMENTS

EP 0 349 069 1/1990

(Continued)

OTHER PUBLICATIONS

Patent Abstracts of Japan, vol. 1995, No. 02, Mar. 31, 1995 & JP 06 314927 A (Meisei Electric Co Ltd), Nov. 8, 1994.

*Primary Examiner*—Shih-Chao Chen
(74) *Attorney, Agent, or Firm*—Frommer Lawrence & Haug LLP; William S. Frommer; Thomas F. Presson

(57) ABSTRACT

An antenna device and a mobile radio communication terminal adapted for improving the performance of an antenna. The antenna device includes a radio circuit for transmitting and receiving a high-frequency signal, a notch antenna having a feeder, and a notch antenna operating through electromagnetic coupling with the notch antenna, and a substrate independent of the radio circuit with respect to high frequencies. The notch antenna includes a linear slit having a length of λ/4 and cut from one edge of the substrate on the reverse side to the position of the radio circuit. The notch antenna includes a linear slit having a length slightly shorter than λ/4 and cut in parallel with the notch antenna from the same edge thereof at a position spaced apart by a predetermined distance d from the notch antenna.

5 Claims, 16 Drawing Sheets

FOREIGN PATENT DOCUMENTS

| | | |
|---|---|---|
| EP | 0 541 276 | 5/1993 |
| JP | 2-52508 | 2/1990 |
| JP | 2-218203 | 8/1990 |
| JP | 7-1619 | 1/1995 |
| JP | 7-111418 | 4/1995 |
| JP | 8-65368 | 3/1996 |
| JP | 8-97760 | 4/1996 |
| JP | 2574616 | 10/1996 |
| JP | 2000-196344 | 7/2000 |
| JP | 2001-523414 | 11/2001 |
| JP | 3283046 | 3/2002 |
| JP | 3286882 | 3/2002 |
| JP | 2003-69441 | 3/2003 |
| WO | WO 98/49742 | 11/1998 |
| WO | WO 01/82408 | 11/2001 |

* cited by examiner

ANTENNA DEVICE AND PORTABLE RADIO COMMUNICATION TERMINAL

This application is a 371 of PCT/JP03/08693 filed on Jul. 9, 2003.

TECHNICAL FIELD

The present invention relates to an antenna device and a mobile radio communication terminal, and more particularly to those adapted for improving the performance of an antenna.

BACKGROUND ART

A notch antenna is a small-sized one realized by opening the edge end of a slot antenna, and it has been used widely heretofore. Particularly, an improved characteristic of a wider frequency band can be obtained by forming this notch antenna on a semi-infinite substrate.

With the recent trend to realize a smaller size and a lighter weight of a mobile telephone, a substrate employed therein also tends to be down-sized. Consequently, if a notch antenna is formed on a substrate to serve as an antenna for a mobile telephone, there arises a problem that a sufficiently wide frequency characteristic is not exactly attainable.

This problem will now be explained below with reference to FIG. 1.

FIG. 1 shows an example of a conventional antenna device provided in a mobile telephone. In the example of FIG. 1, a notch antenna 2 with a feeder 3 is formed on a substrate 1 having a horizontal length of 0.27 λr and a vertical length of 0.5 λr. The whole of this notch antenna 2 is shaped substantially into L in such a manner as to be bent rightward at a position corresponding to a length of 0.04 λr from one edge (lower end in the diagram) of the substrate 1, and to be cut to have a length of 0.13 λr from the bent position. In this diagram, λr denotes the length of the electric wave transmitted from or received by the mobile telephone.

FIGS. 2A and 2B graphically show the input impedance characteristic obtained in the case of employing the general antenna device of FIG. 1 in a mobile telephone. FIG. 2A is a Smith chart representing the impedance characteristic of the antenna device, and FIG. 2B shows a VSWR (Voltage Standing Wave Ratio) representing the impedance matching of the antenna device.

In FIG. 2A, there is indicated that a locus m1 representing the impedance characteristic of the antenna device is apart from the center O. It is therefore understood that the impedance characteristic of the antenna device is not a wide-band characteristic.

In FIG. 2B, the abscissa denotes frequencies, wherein the frequency becomes higher (1.25f0) rightward or becomes lower (0.75f0) leftward from a predetermined center frequency f0. The ordinate denotes the value of VSWR which becomes greater upward. This antenna device is formed of the notch antenna 2 and has a uni-resonance characteristic, so that VSWR=4.5 at the end of a band-width BW (0.94f0 to 1.06f0) for example. This indicates that the radiation efficiency due to the loss derived from mismatching of the impedance to the radio circuit is deteriorated by at least 36%, hence signifying that a sufficient band width is not attained in this antenna device.

In the recent down-sized mobile telephones, as described above, the substrate with a notch antenna formed thereon is rendered relatively small in comparison with the wavelengths of signals to be processed by the mobile telephone, and accordingly there exists a problem that a sufficiently wide band characteristic fails to be ensured in any conventional antenna device.

Further, FIG. 3 graphically shows the electric distribution on the substrate surface in the antenna device of FIG. 1. In FIG. 3, the substrate surface can be divided into, for example, an extent e1 where high-frequency currents are not much distributed, an extent e2 where high-frequency currents are distributed moderately, and an extent e3 where high-frequency currents are concentrated. And the slit portion of the notch antenna 2 is included in the extent e3 where high-frequency currents are concentrated, thereby indicating concentration of high-frequency currents in the cut portion of the notch antenna 2.

Consequently, in this antenna device, if a human body or the like is in the proximity of the slit portion of the notch antenna 2 where high-frequency currents are concentrated, the input impedance characteristic is rendered lower in resistance due to its uni-resonance, hence causing mismatching to the radio circuit. As a result, the radiation efficiency of the antenna device is lowered to eventually deteriorate the antenna characteristic extremely.

DISCLOSURE OF INVENTION

The present invention has been accomplished in view of the circumstances mentioned above, and its object resides in improving the performance of the antenna.

A first antenna device of the present invention comprises a substrate independent of a radio circuit with respect to high frequencies; a first notch antenna in slit-shape formed on the substrate and having a feeder; and a second notch antenna in slit-shape operating through electromagnetic coupling with the first notch antenna.

The second notch antenna may be so formed as to be different in slit length from the first notch antenna.

The second notch antenna may be formed substantially in parallel with the first notch antenna in such a manner that main polarization thereof becomes coincident with that of the first notch antenna.

Each of the slits in the first and second notch antennas may be shaped into an L, zigzag or meander.

The second notch antenna may be so formed as to have two or more slits of mutually different lengths.

The open end of the first notch antenna and the open end of the second notch antenna may be connected to a common open end.

A metallic, dielectric or magnetic member may be disposed between the open end of the first notch antenna and the open end of the second notch antenna.

At least one of the first and second notch antennas may have a concentrated constant element.

The second notch antenna may have a phaser to give a desired reactance value.

A second antenna device of the present invention comprises a substrate independent of a radio circuit with respect to high frequencies; a first antenna formed on the substrate and consisting of a slit-shaped notch antenna having a feeder; and a second antenna disposed in the vicinity of an open end of the first antenna in such a manner that the direction of main polarization thereof becomes coincident with that of the first antenna, and operating through electromagnetic coupling with the first antenna.

The second antenna is a linear antenna which may be shaped into a zigzag, helical, meander or loop.

The second antenna may be a notch antenna formed on another substrate different from the substrate where the first antenna is formed.

A first mobile radio communication terminal of the present invention comprises a substrate independent of a radio circuit with respect to high frequencies; a first notch antenna in slit-shape formed on the substrate and having a feeder; a second notch antenna in slit-shape formed on the substrate and operating through electromagnetic coupling with the first notch antenna; and a body for housing the substrate.

The body consists of a first body for housing the substrate, and a second body openable and closable in regard to the first body, wherein the open ends of the first and second notch antennas may be disposed in a portion of the first body that projects from the second body when the first and second bodies are in a closed state.

A second mobile radio communication terminal of the present invention comprises a substrate independent of a radio circuit with respect to high frequencies; a first antenna formed on the substrate and consisting of a slit-shaped notch antenna having a feeder; a second antenna disposed in the vicinity of an open end of the first antenna in such a manner that the direction of main polarization thereof becomes coincident with that of the first antenna, and operating through electromagnetic coupling with the first antenna; and a body for housing the first and second antennas.

The body consists of a first body for housing the substrate, and a second body openable and closable in regard to the first body, wherein the open end of the first antenna and the second antenna may be disposed in a portion of the first body that projects from the second body when the first and second bodies are in a closed state.

In the first invention, a substrate is kept independent of a radio circuit with respect to high frequencies, and a first notch antenna in slit-shape having a feeder and a second notch antenna in slit-shape operating through electromagnetic coupling with the first notch antenna are formed on the substrate.

And in the second invention, a substrate is kept independent of a ratio circuit with respect to high frequencies, and a first antenna consisting of a slit-shaped notch antenna with a feeder is formed on the substrate. And a second antenna operating through electromagnetic coupling with the first antenna is disposed in the vicinity of an open end of the first antenna in such a manner that the direction of main polarization thereof becomes coincident with that of the first antenna.

BEST MODE FOR CARRYING OUT THE INVENTION

Hereinafter some embodiments of the present invention will be described with reference to the accompanying drawings.

Figure 4:
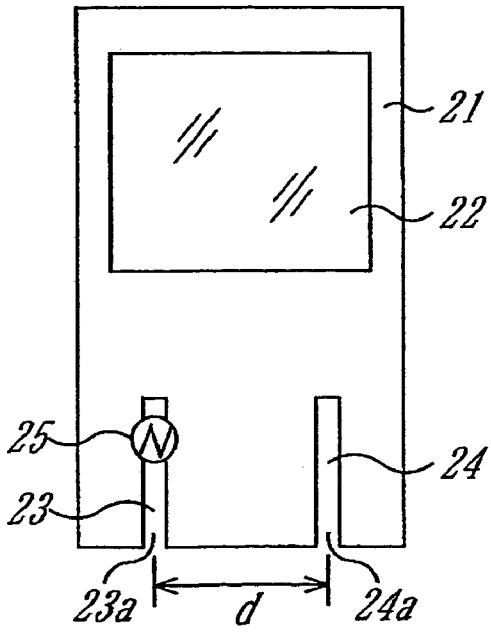
FIG. 4 is a diagram showing a structural example of an antenna device in a mobile telephone where the present invention is applied.

FIG. 4 is a diagram showing a structural example of an antenna device formed on a substrate which is housed in a mobile telephone where the present invention is applied. On this substrate, there are also provided various circuits including a microphone, a speaker, a display, a controller and so forth which are omitted in the example of FIG. 4 for the convenience of explanation. This substrate serves as a reference potential ground to which these circuits are connected.

In FIG. 4, the antenna device comprises a radio circuit 22 for transmitting/receiving a high-frequency signal to/from a nearby base station (not shown) or the like, and a substrate 21 where a notch antenna 23 and a notch antenna 24 are provided. This substrate 21 is kept independent of the radio circuit 22 with respect to high frequencies.

On the substrate 21, the notch antenna 23 is so formed as to have an open end 23*a* with a linear slit of a predetermined width and a length of λ/4 from one edge of the substrate 21 (lower side in the diagram) on the reverse side with regard to the position of the radio circuit 22. The notch antenna 23 has a feeder 25, and operates in accordance with a high-frequency current obtained from the radio circuit 22 via the feeder 25.

The notch antenna 24 is so formed as to have an open end 24*a* with a linear slit of a length slightly shorter than λ/4 and cut in the same direction as that of the notch antenna 23 from the same edge thereof at a position spaced apart by a distance d from the notch antenna 23. The notch antenna 24 is formed in parallel with the notch antenna 23 and is equal thereto in width. The notch antenna 24 has not a feeder 25 and operates through electromagnetic coupling with the notch antenna 23.

The notch antenna 23 and the notch antenna 24 are in such a relationship that the electromagnetic coupling thereof tends to increase or decrease in intensity as the distance d becomes shorter or longer (particularly when the distance d between the open end 23*a* and the open end 24*a* becomes shorter or longer). According to some experiments, when the wavelength corresponding to a reference frequency F0 for example is λ, it is preferred that the length of the distance d be in a range of λ/30 to λ/5.

It is possible to achieve multi-resonance of the antenna device, i.e., to widen the band thereof, by slightly changing the lengths of the two notch antennas 23 and 24. And the directions of main polarization can be rendered coincident by forming the slits of the two antennas in the same direction (in parallel with each other).

Figure 5:
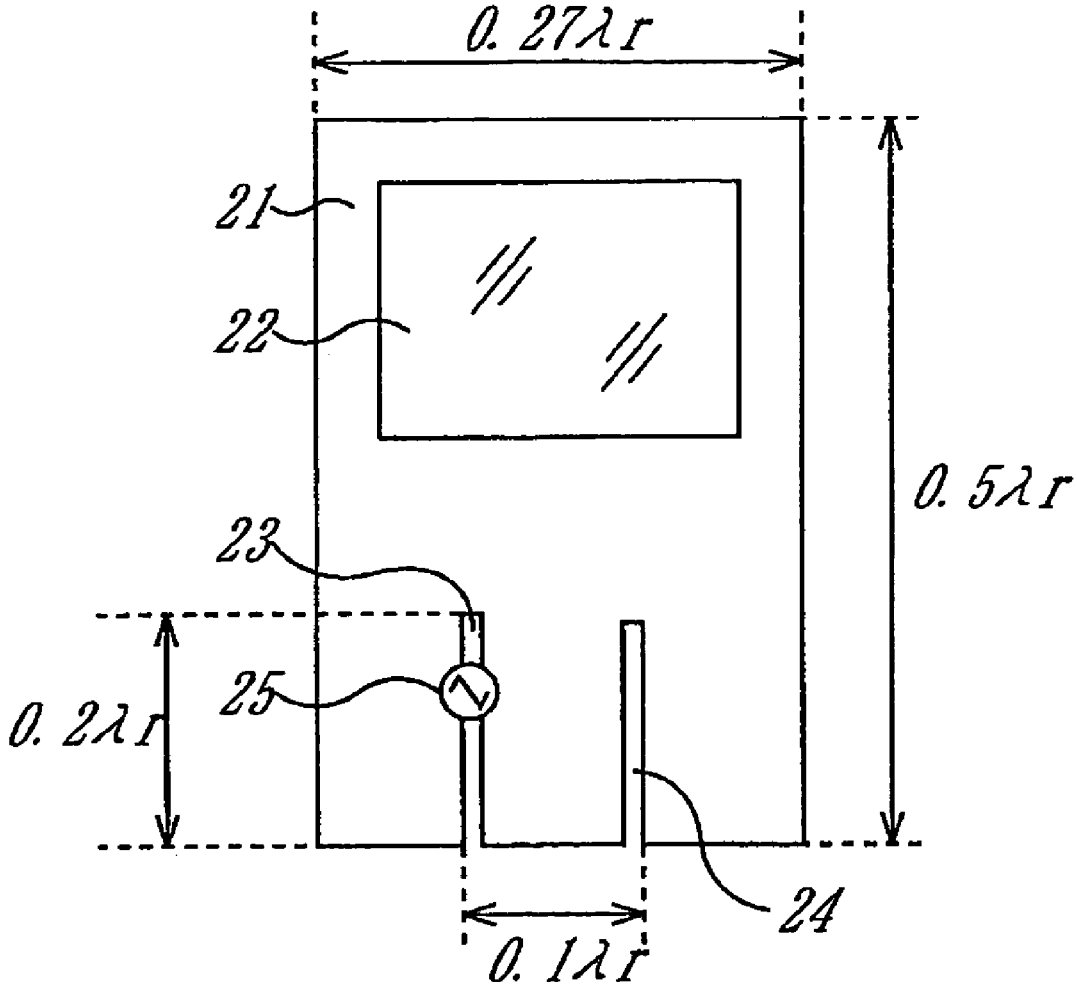
FIG. 5 is a diagram showing a concrete structural example of the antenna device of FIG. 4.

FIG. 5 is a diagram showing a concrete structural example of the antenna device of FIG. 4. In FIG. 5, any component parts corresponding to those in FIG. 4 are denoted by like reference numerals or symbols, and a repeated explanation thereof will be omitted below.

In FIG. 5, the substrate 21 is so sized as to have a horizontal length of 0.27 λr and a vertical length of 0.5 λr, where λr denotes the wavelength of a communication radio wave. A notch antenna 23 is formed of a linear slit cut in a length of 0.2 λr from one edge of the substrate 1. And a notch antenna 24 operating through electromagnetic coupling with the notch antenna 23 is formed of another slit cut at a position spaced apart from the notch antenna 23 rightward by a distance of 0.1 λr and in parallel with the notch antenna 23. The slit of the notch antenna 24 is formed to be slightly shorter than 0.2 λr which is the length of the notch antenna 23.

In the antenna device of FIG. 5, as described above, the notch antenna 24 operating through electromagnetic coupling is adjusted, by its dimension parameters, in a manner to tune with the notch antenna 23 having a feeder 25.

Figure 6A:
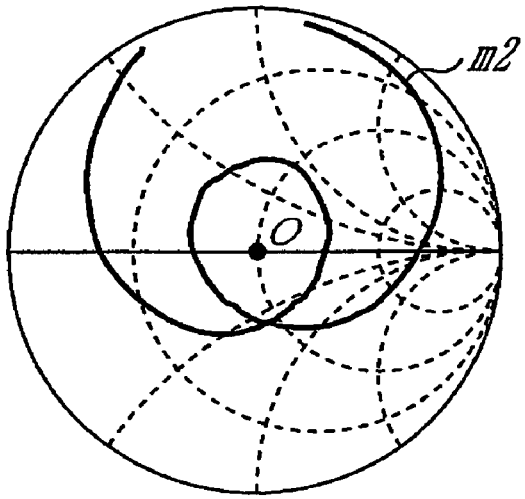
FIG. 6A is a diagram for illustrating the impedance of the antenna device shown in FIG. 5.
Figure 6B:
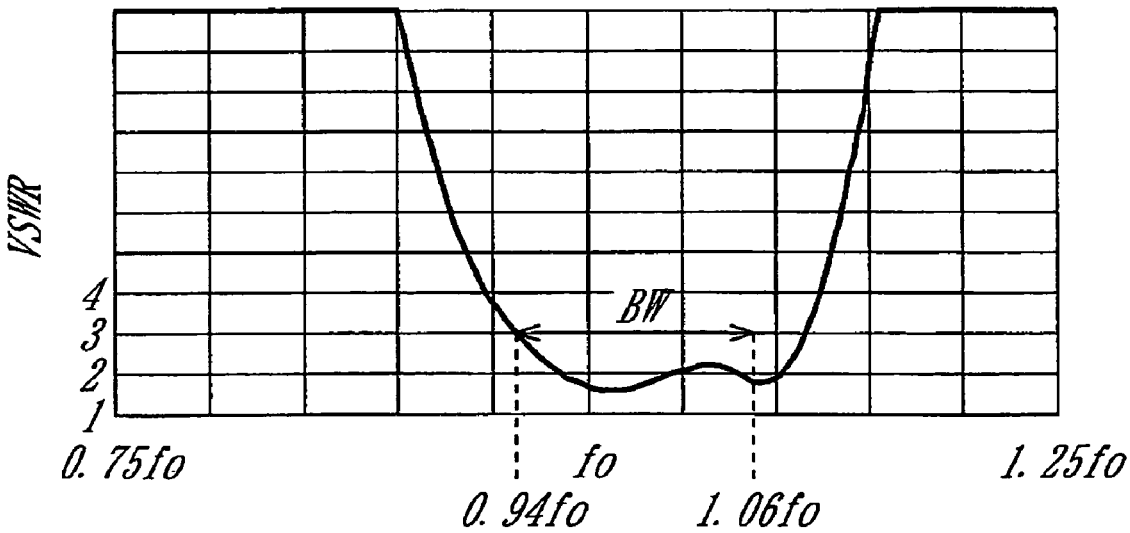
FIG. 6B graphically illustrates the impedance characteristic of the antenna device shown in FIG. 5.

The input impedance characteristic of the antenna device of FIG. 5 is shown in FIGS. 6A and 6B. FIG. 6A is a Smith chart representing the impedance characteristic of the antenna device, and FIG. 6B graphically shows the voltage standing wave ratio (VSWR) characteristic that indicates the impedance matching of the antenna device.

In FIG. 6A, a locus m2 expressing the impedance characteristic of the antenna device is an α type which concentrates on the center O of the Smith chart, thereby signifying that the impedance characteristic of the antenna device is rendered adequate for a wider band.

In FIG. 6B, the abscissa indicates a frequency, which becomes higher (1.25f0) rightward or lower (0.75f0) leftward from a predetermined center frequency f0 (=1/λ r). And the ordinate indicates the value of VSWR which becomes greater upward. This signifies that the impedance matching is enhanced as the value of VSWR is smaller.

Figure 1:
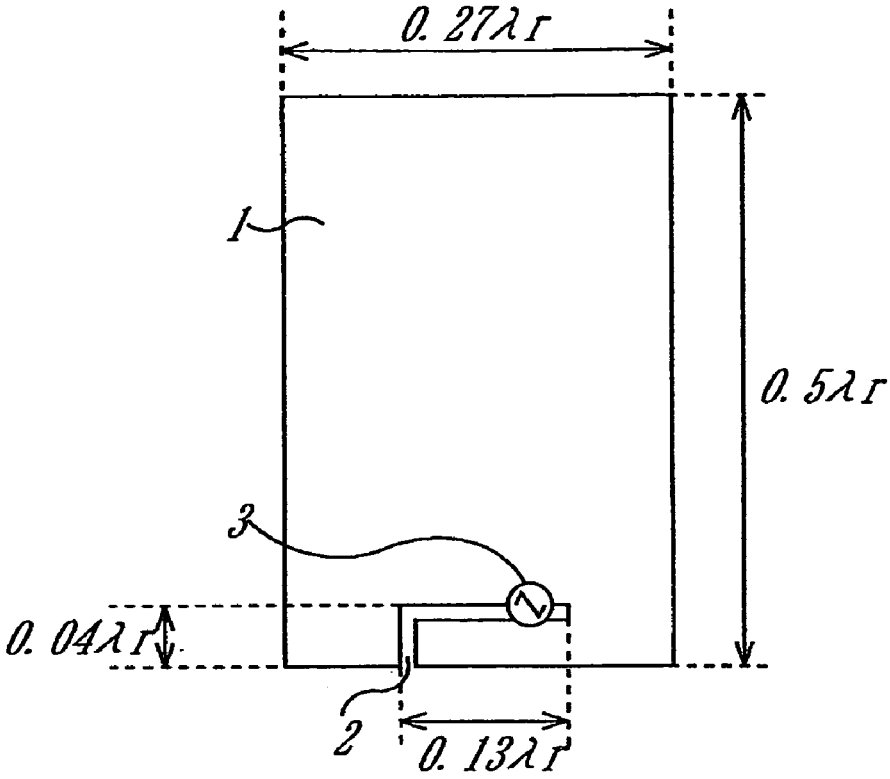
FIG. 1 RELATED ART
FIG. 1 is a diagram showing a structural example of an antenna device used in a conventional mobile telephone.
Figure 2A:
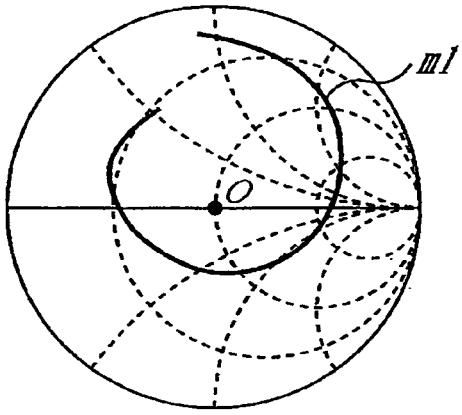
FIG. 2A RELATED ART
FIG. 2A is a diagram for illustrating the impedance characteristic of the antenna device shown in FIG. 1.
Figure 2B:
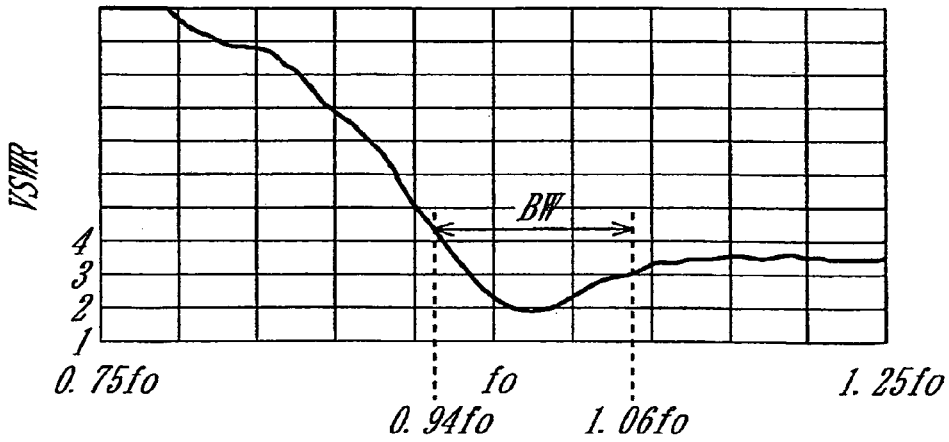
FIG. 2B RELATED ART
FIG. 2B graphically illustrates the impedance characteristic of the antenna device shown in FIG. 1.
Figure 3:
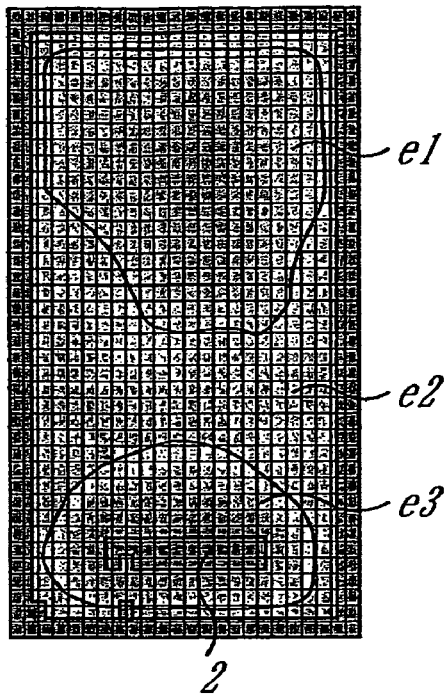
FIG. 3 RELATED ART
FIG. 3 is a diagram for illustrating a current distribution in the antenna device of FIG. 1.

In the example of FIG. 6B, the maximum VSWR is 3.0 in a band width BW of 0.94f0 to 1.06f0. This indicates that the radiation efficiency is deteriorated 14% by the loss derived from the impedance mismatching with at least the radio circuit 22. That is, according to this antenna device, the radiation efficiency thereof is improved 22% in comparison with the conventional antenna device explained with reference to FIG. 2 where the radiation efficiency is 36%.

Figure 7A:
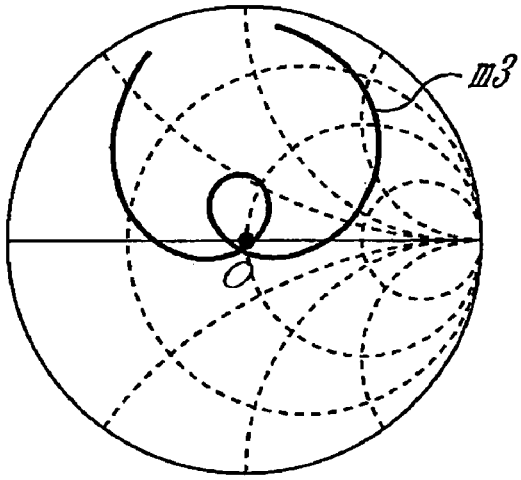
FIG. 7A is a diagram for illustrating another example of the impedance characteristic of the antenna device shown in FIG. 5.
Figure 7B:
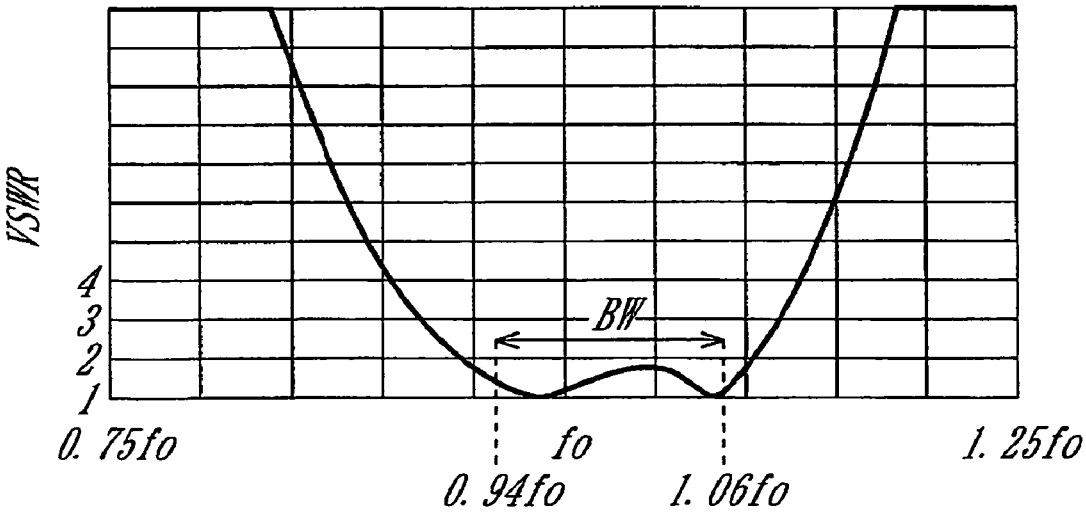
FIG. 7B graphically illustrates another example of the impedance characteristic of the antenna device shown in FIG. 5.
Figure 8A:
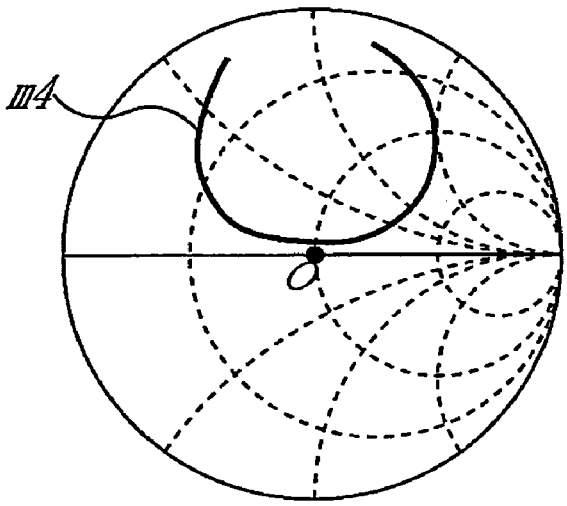
FIG. 8A is a diagram for illustrating a further example of the impedance characteristic of the antenna device shown in FIG. 5.

Referring now to FIGS. 7A, 7B, 8A and 8B, an explanation will be given on the input impedance characteristic of the mobile telephone, which is equipped with the antenna device of FIG. 5, in case the telephone is held by a hand. Each of FIGS. 7A and 8A is a Smith chart representing the impedance characteristic of the antenna device, and each of FIGS. 7B and 8B graphically shows the voltage standing wave ratio (VSWR) characteristic that indicates the impedance matching of the antenna device.

FIGS. 7A and 7B represent the impedance characteristic of the antenna device obtained when the upper halves of the slits of the notch antennas 23 and 24 are covered with a hand. In FIG. 7A, a locus m3 expressing the impedance characteristic of the antenna device is an α type which concentrates on the center O of the Smith chart, thereby signifying that the antenna device has a wide-band characteristic. In FIG. 7B, the VSWR of the antenna device is less than 1.8 in a band width BW of 0.94f0 to 1.06f0, hence signifying that a stable impedance characteristic is attained.

Figure 8B:
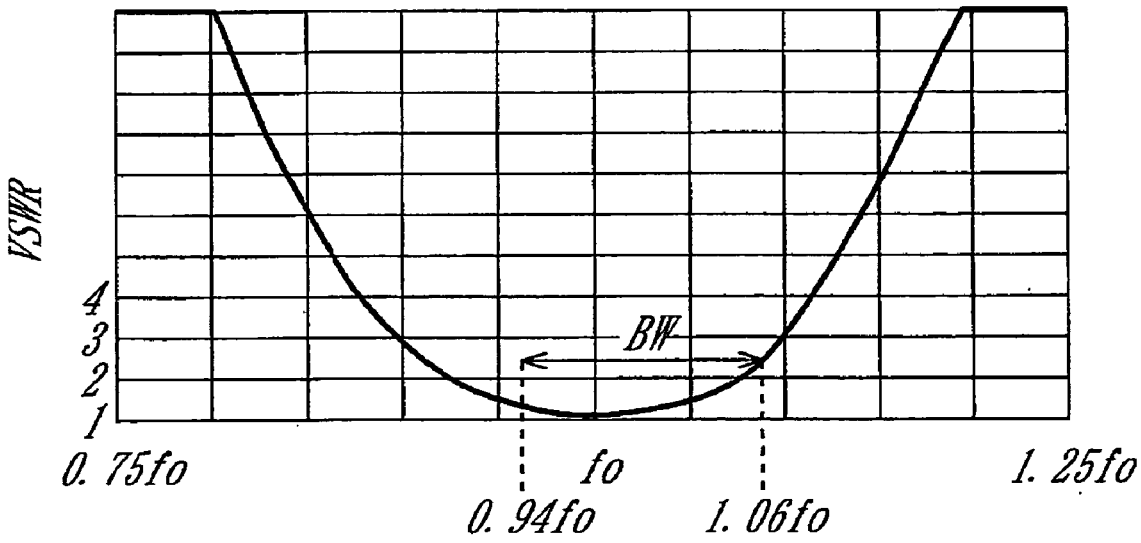
FIG. 8B graphically illustrates a further example of the impedance characteristic of the antenna device shown in FIG. 5.

FIGS. 8A and 8B graphically show the impedance characteristic obtained when the slits of the notch antennas 23 and 24 are entirely covered with a hand. In FIG. 8A, a locus m4 expressing the impedance characteristic of the antenna device concentrates on the vicinity of the center O of the Smith chart, thereby signifying that the wide-band characteristic of the antenna device is still maintained. In FIG. 8B, the VSWR of the antenna device is less than 2.2 in a band width BW of 0.94f0 to 1.06f0, hence signifying that a stable impedance characteristic is attained.

As described above, the notch antenna 24 operating through electromagnetic coupling is adjusted by its dimension parameters in a manner to be capable of tuning, despite the disturbance or influence of a hand, with the notch antenna 23 having the feeder 25, so that a stable wide-band impedance characteristic can be attained.

A further explanation will be given on another structural example of an antenna device formed on an internal substrate of a mobile telephone where the present invention is applied. In the following description, any component parts corresponding to those used in FIG. 4 are denoted by like reference numerals or symbols, and a repeated explanation thereof will be omitted below.

Figure 9:
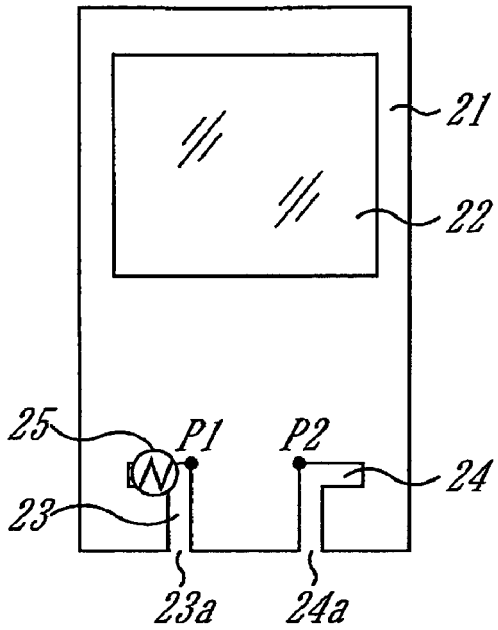
FIG. 9 is a diagram showing another structural example of the antenna device where the present invention is applied.

In an antenna device of FIG. 9, a notch antenna 23 having a feeder 25 is formed in the shape of L as its slit is bent leftward in the diagram at a position (point P1) of a predetermined length from an open end 23*a* on one edge of a substrate 21 and is cut from the point P1 to a predetermined position (end point). Another notch antenna 24 operating through electromagnetic coupling with the notch antenna 23 is formed in the shape of L as its slit is bent rightward in the diagram at a position (point P2) of a predetermined length from an open end 24*a* of one edge of the substrate 21 and is cut from the point P2 to a predetermined position (end point).

In the notch antenna 23, a total length including the length from the open end 23*a* of the substrate 21 to the point P1 and the length from the point P1 to the end point is set to λ/4. Meanwhile in the notch antenna 24, a total length including the length from the open end 24*a* of the substrate 21 to the point P2 and the length from the point P2 to the end point is set to be slightly shorter than λ/4. Therefore, it becomes possible to shorten the slit length in the longitudinal direction of the substrate 21 (i.e., from the open ends 23*a*, 24*a* of the substrate 21 to the points P1, P2), so that the antenna device of FIG. 9 composed of the notch antennas 23 and 24 can be down-sized in comparison with the antenna device of FIG. 4.

Although each slit of the notch antennas 23 and 24 is shaped into L in FIG. 9, it may be a meander or zigzag as well.

Figure 10:
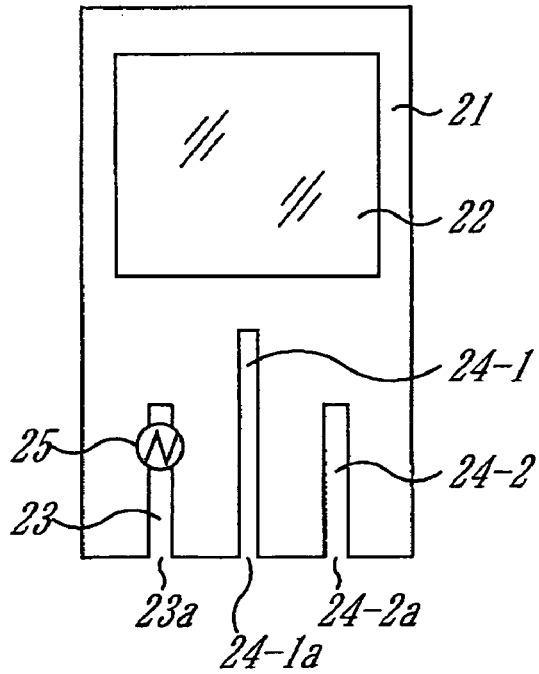
FIG. 10 is a diagram showing a further structural example of the antenna device where the present invention is applied.

In an antenna device of FIG. 10, a notch antenna operating through electromagnetic coupling with a notch antenna 23 is composed of two notch antennas 24-1 and 24-2 which are formed of two linear slits each having a predetermined length from one edge of a substrate 21. The notch antenna 24-1 is formed at a position spaced apart rightward by a predetermined distance from the notch antenna 23 and has a length slightly greater than λ/4 from an open end 24-1*a*. And the notch antenna 24-2 is formed at a position spaced apart rightward by a predetermined distance from the notch antenna 24-1 and has a length slightly shorter than λ/4. These notch antennas 24-1 and 24-2 are formed in parallel with the notch antenna 23.

Thus, in the antenna device of FIG. 10, a plurality of notch antennas operating through electromagnetic coupling are so formed as to have mutually different lengths, whereby the whole resonance band can be widened as compared with that obtained in the case of a single notch antenna. Normally, the resonance of antennas is expressed as (λ/4)×N (number of antennas), so that multi-resonance can be achieved by the notch antennas 24-1 and 24-2 at a desired frequency different from that of the notch antenna 23 having the feeder 25.

Although FIG. 10 shows merely two notch antennas 24-1 and 24-2 operating through electromagnetic coupling, the number thereof may be three or more. Further, although the notch antenna 23 is disposed on the left side while the notch antennas 24-1 and 24-2 are disposed on the right side, the disposition thereof may be reverse as well, and the arrangement does not matter.

Figure 11:
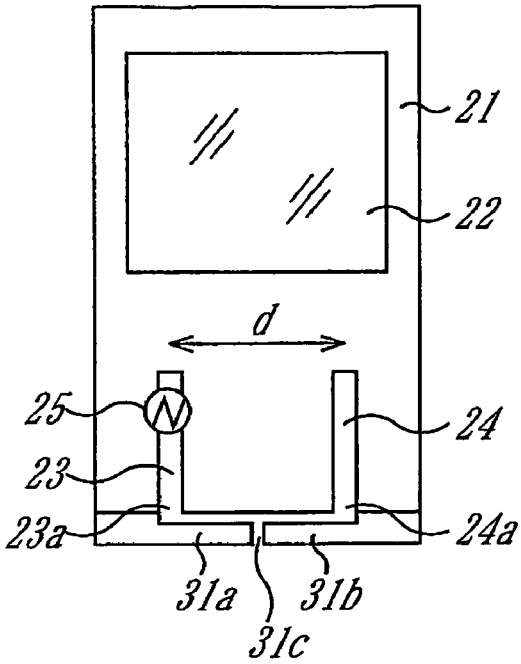
FIG. 11 is a diagram showing a further structural example of the antenna device where the present invention is applied.

In an antenna device of FIG. 11, metallic conductor members 31*a* and 31*b* connected to a substrate 21 are disposed proximate to each other in the vicinity of an open end 23*a* of a notch antenna 23 and an open end 24*a* of another notch antenna 24 on the substrate 21. (The metallic conductor members 31*a* and 31*b* may be composed of the substrate 21.) In this structure, it is possible to strengthen the electromagnetic coupling which is weakened by some reason such as impossibility of shortening the distance d between the notch antennas 23 and 24 in view of the positional relationship to some other component parts.

This structure can be recognized as to oppose the metallic conductor members 31*a* and 31*b* to each other via an open end 31*c*, or can be recognized as to connect the open end 23*a* and the open end 23*b* to the open end 31*c* which is used as a common open end.

As described, in the antenna device of FIG. 11, adjustment to strengthen the electromagnetic coupling is rendered possible by proximately disposing the substrate 21 or the metallic conductor member 31 connected thereto, hence coping with the problem that, on the substrate 21, the notch antennas 23 and 24 cannot be disposed at ideal positions thereof due to the relationship to other component parts (not shown) and consequently the electromagnetic coupling between the two notch antennas is weakened.

Figure 12:
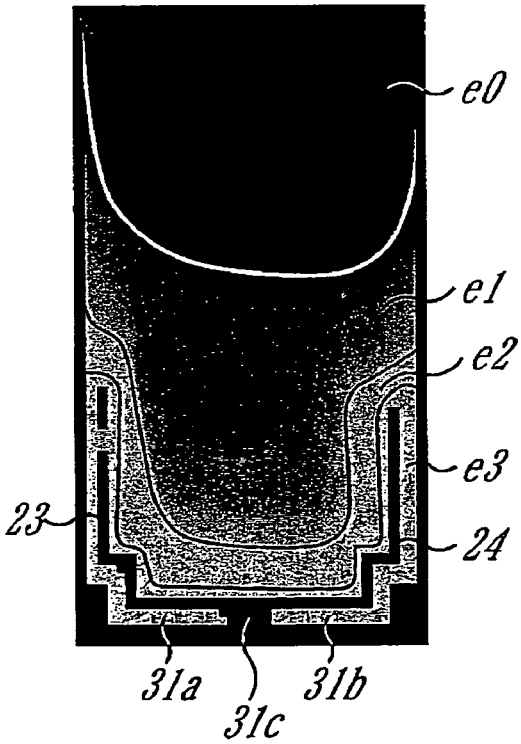
FIG. 12 is a diagram for illustrating a current distribution in the antenna device of FIG. 11.

Further, FIG. 12 is a diagram showing the electric distribution on the surface of the substrate in the antenna device of FIG. 11. In FIG. 12, the entire distribution can be divided into, for example, an extent e0 where almost none of high-frequency currents is distributed, an extent e1 where high-frequency currents are not distributed much, an extent e2 where high-frequency currents are distributed moderately, and an extent e3 where high-frequency currents are distributed concentratively. As indicated in the extent e3 where the high-frequency currents are distributed concentratively, according to the antenna device of FIG. 11, the open end 24*a* of the notch antenna 24 operating through electromagnetic coupling is connected to the common open end 31*c* together with the open end 23*a* of the notch antenna 23 having the feeder 25, whereby the high-frequency currents are dispersed in the two antennas (notch antennas 23 and 24). Consequently, even if one notch antenna 23 is affected by some disturbance such as touch of a human body for example, another notch antenna 24 is existent and therefore the input impedance characteristic is not varied with ease to eventually attain stability in the impedance characteristic.

Figure 13:
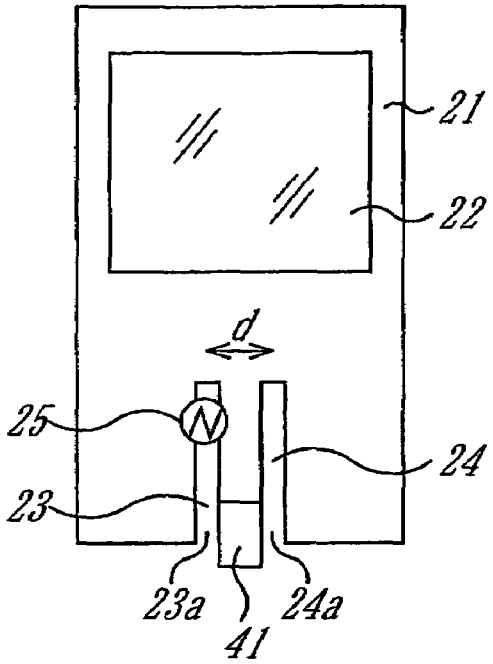
FIG. 13 is a diagram showing a further structural example of the antenna device where the present invention is applied.

Next in an antenna device of FIG. 13, a metallic member 41 is interposed between a notch antenna 23 and a notch antenna 24 on one side of a substrate 21 where an open end 23*a* of the notch antenna 23 and an open end 24*a* of the notch antenna 24 are formed. In this case, contrary to the antenna device of FIG. 11, it is possible to weaken the electromagnetic coupling strengthened in excess by some reason that the distance d between the notch antennas 23 and 24 is excessively small.

The metallic member 41 may be a dielectric member or a magnetic member without being limited to metal alone if it is effective to weaken the electric field.

As described, in the antenna device of FIG. 13, adjustment to weaken the electromagnetic coupling is rendered possible by disposing a metallic member or the like between the notch antennas 23 and 24, hence coping with the problem that, on the substrate 21, the notch antennas 23 and 24 cannot be disposed at ideal positions thereof due to the relationship to some other component parts (not shown) and consequently the electromagnetic coupling therebetween is strengthened in excess.

Figure 14:
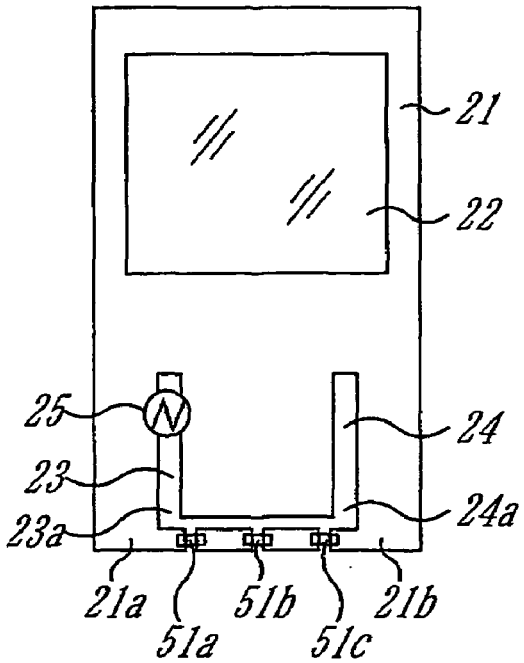
FIG. 14 is a diagram showing a further structural example of the antenna device where the present invention is applied.

In an antenna device of FIG. 14, as in the aforementioned antenna device of FIG. 11, portions of a substrate 21 are extended as substrates 21*a* and 21*b* on one side thereof where an open end 23*a* of a notch antenna 23 and an open end 24*a* of a notch antenna 24 are formed, and the substrates 21*a* and 21*b* are proximate to each other. And concentrated constant elements 51*a*, 51*b* and 51*c* consisting of capacitors, conductors or the like are disposed on the mutually proximate substrates 21*a* and 21*b*. In the example of FIG. 14, for instance, the center concentrated constant element 51*b* out of such concentrated constant elements 51*a*, 51*b* and 51*c* consists of a capacitor while the other concentrated constant elements 51*a* and 51*c* consist of conductors, and the intensity of the electromagnetic coupling can be adjusted by changing the capacitance C of the concentrated constant element 51*b* which consists of a capacitor.

As described, in the antenna device of FIG. 14, the antenna characteristic is adjustable by providing the concentrated constant elements in portions of the substrate 21 as well as by changing the slit dimensions of the notch antennas or the distance between the notch antennas.

Figure 15:
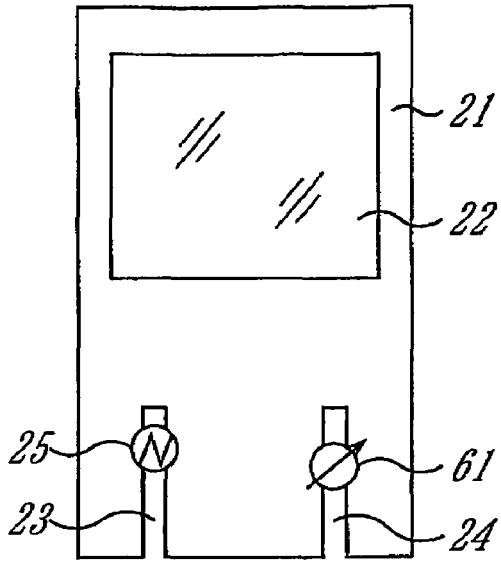
FIG. 15 is a diagram showing a further structural example of the antenna device where the present invention is applied.

Further in an antenna device of FIG. 15, a phaser 61 having a desired reactance component is provided at a position of the notch antenna 24 included in the antenna device of FIG. 4 and operating through electromagnetic coupling. Since the intensity of the electromagnetic coupling is adaptively changeable by the phaser 61 in this antenna device of FIG. 15, it is possible to set the intensity of the electromagnetic coupling to an optimal value thereof when the optimal value of such intensity varies depending on whether the mobile terminal using this antenna device is held or not by the user's hand for example.

Thus, in the antenna device of FIG. 15, the antenna characteristic inclusive of the impedance and the radiation pattern can be adjusted as desired by means of the phaser 61 connected to the notch antenna 24 which operates through electromagnetic coupling. Moreover, since the phaser 61 is capable of changing the phase quantity to a desired value, the antenna characteristic is adjusted actively in accordance with the communication environment.

As described, the notch antenna operating through electromagnetic coupling is formed on one substrate where another notch antenna having a feeder is formed, in a manner to generate the same main polarization, and the relationship between such notch antennas is adjusted with regard to the shapes of slits and the distance therebetween, or a metallic member, a concentrated constant element or a phaser is additionally provided therein, so that the input impedance characteristic of the antenna device can be rendered adequate for a wider band, i.e., for attaining multi-resonance.

Figure 16:
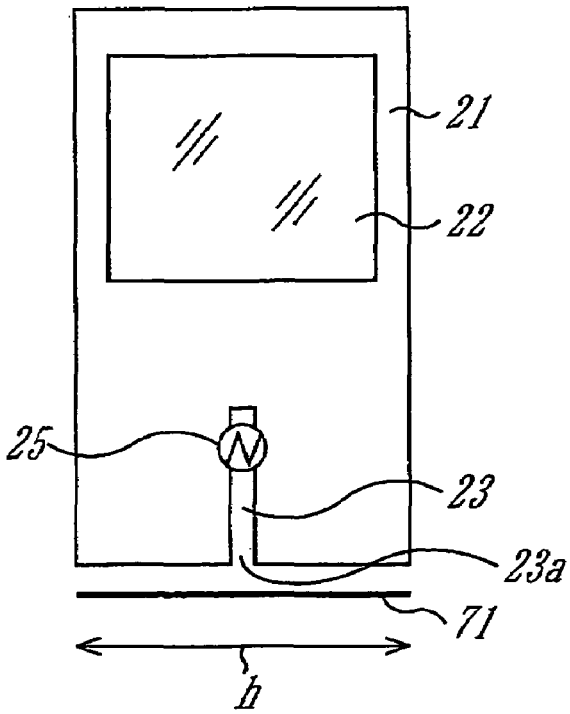
FIG. 16 is another structural example of the antenna device where the present invention is applied.
Figure 17:
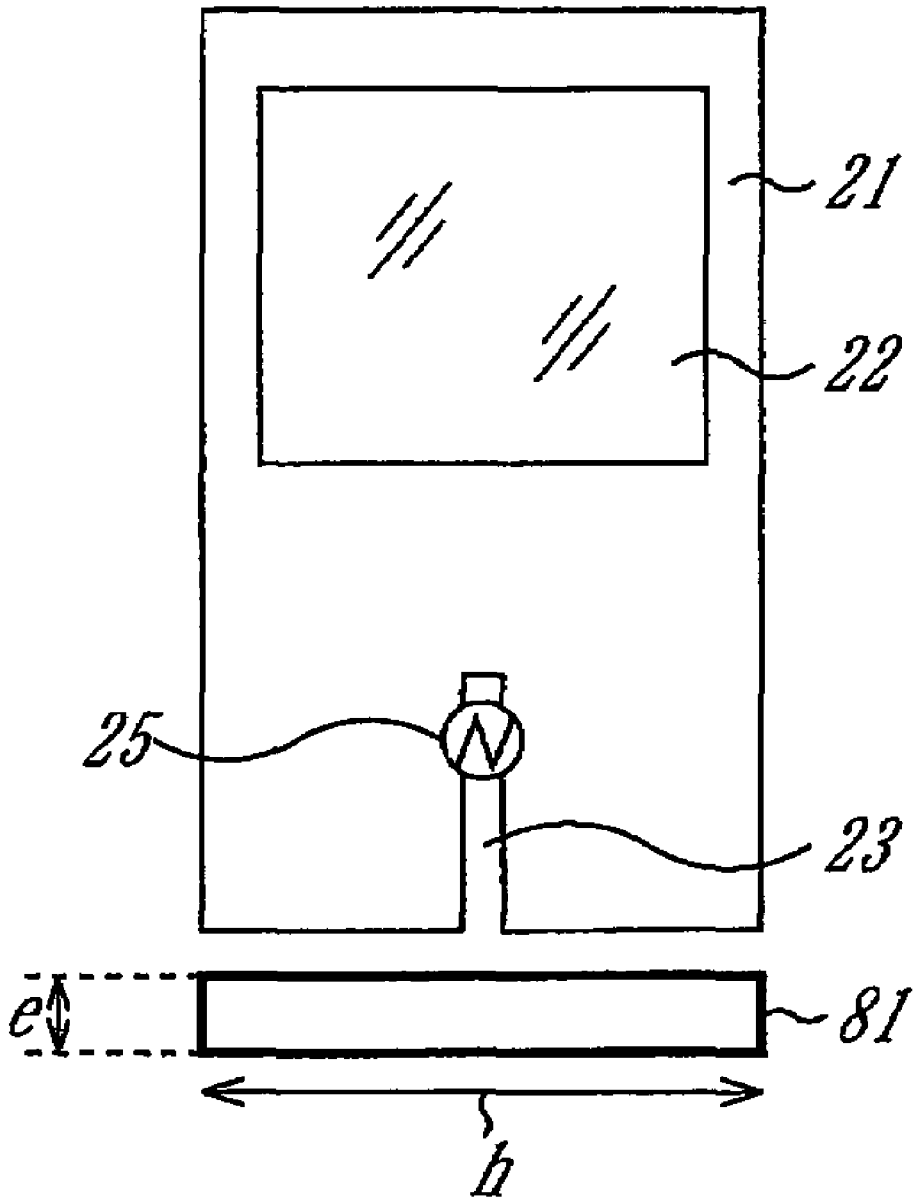
FIG. 17 is a diagram showing a further structural example of the antenna device where the present invention is applied.

Referring next to FIGS. 16 and 17, an explanation will be given on an antenna device where one antenna, which operates through electromagnetic coupling with a notch antenna 23 having a feeder 25, is disposed at some other position than a substrate 21 where a notch antenna 23 is formed.

In the antenna device shown as an example in FIG. 16, a linear antenna 71 is used as an antenna operating through electromagnetic coupling with a notch antenna 23 having a feeder 25. The antenna 71 operating through electromagnetic coupling with the notch antenna 23 has a length of $\lambda/2$ and is disposed in the vicinity of an open end 23*a* of the notch antenna 23. This linear antenna 71 is positioned orthogonally to a slit of the notch antenna 23 in such a manner that the main polarization thereof becomes directionally coincident with that of the notch antenna 23. Consequently, since the main polarization direction of the notch antenna 23 is transverse to its slit (i.e., horizontal in the diagram), the main polarization direction h (i.e., longitudinal) of the linear antenna 71 can be rendered coincident (parallel) with the main polarization direction of the notch antenna 23.

Generally, most users talk (in use) while holding the mobile telephone with a slight tilt to the horizontal direction, and therefore the main polarization direction h of the linear antenna 71 is almost vertical to the ground during communication to consequently become coincident with the vertical polarization direction of the base station for the mobile telephone, so that the gain tends to be greater.

In the example of FIG. 16, the linear antenna 71 is shaped into a straight line, but it may be a meander, zigzag or helical as well.

In the antenna device shown as an example in FIG. 17, there is employed, instead of the linear antenna 71 in FIG. 16, a folded antenna 81 shaped by looping an antenna of a length $\lambda$. Similarly to the linear antenna 71, the folded antenna 81 also is so disposed as to be coincident with the main polarization direction h. Therefore, the same advantageous effect is achievable as in the linear antenna 71 of FIG. 16.

In this case, the fold-back distance e of the folded antenna 81 orthogonal to the main polarization direction h is set to be extremely small.

In the example mentioned above, the antenna operating through electromagnetic coupling is so disposed that the main polarization direction thereof becomes coincident with that of the notch antenna 23 having the feeder 25 in the vicinity thereof, whereby the same advantageous effect can be achieved as in the antenna device shown in FIG. 4.

Referring now to FIGS. 18A and 18B, 19A and 19B, and 20A to 20C, an explanation will be given on some cases of applying the above-described antenna device to a mobile telephone. It is to be supposed that, in the description below, the antenna device shown in FIG. 4 is employed in a mobile telephone.

Figure 18B:
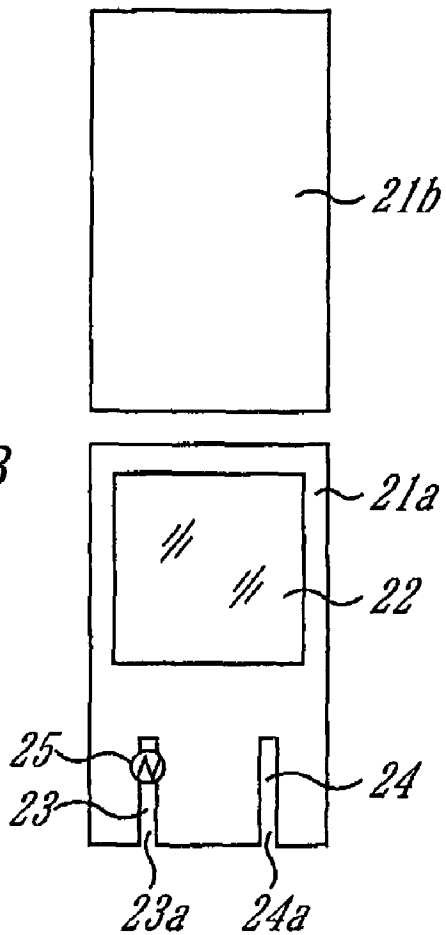
FIG. 18B is a diagram showing an internal structural example of the mobile telephone using the antenna device of FIG. 4.
Figure 18A:
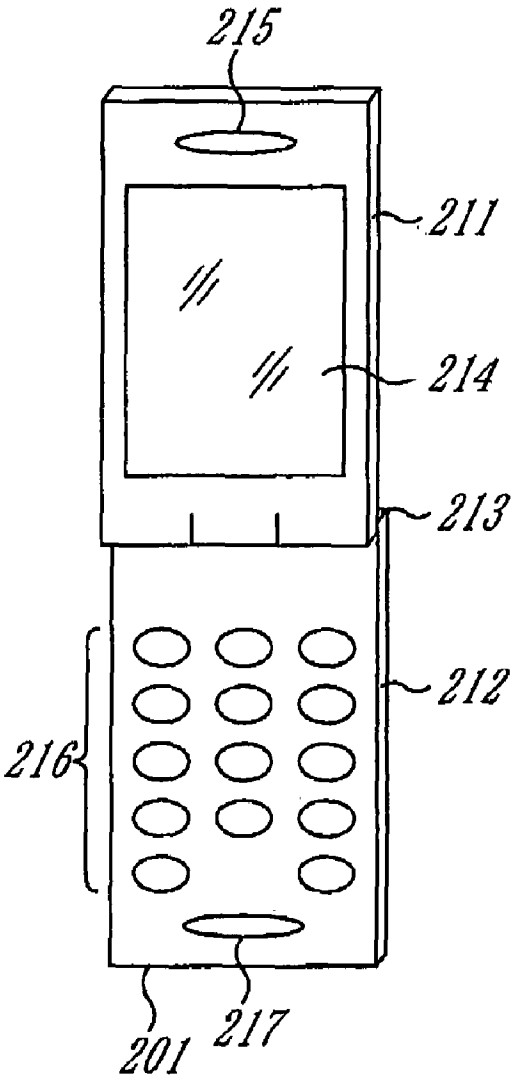
FIG. 18A is a diagram showing an external structural example of a mobile telephone using the antenna device of FIG. 4.
Figure 19B:
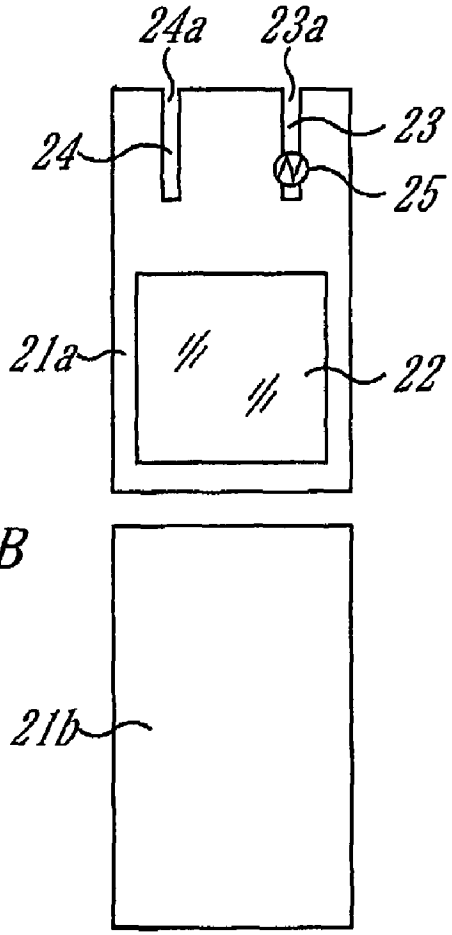
FIG. 19B is a diagram showing another internal structural example of the mobile telephone using the antenna device of FIG. 4.
Figure 19A:
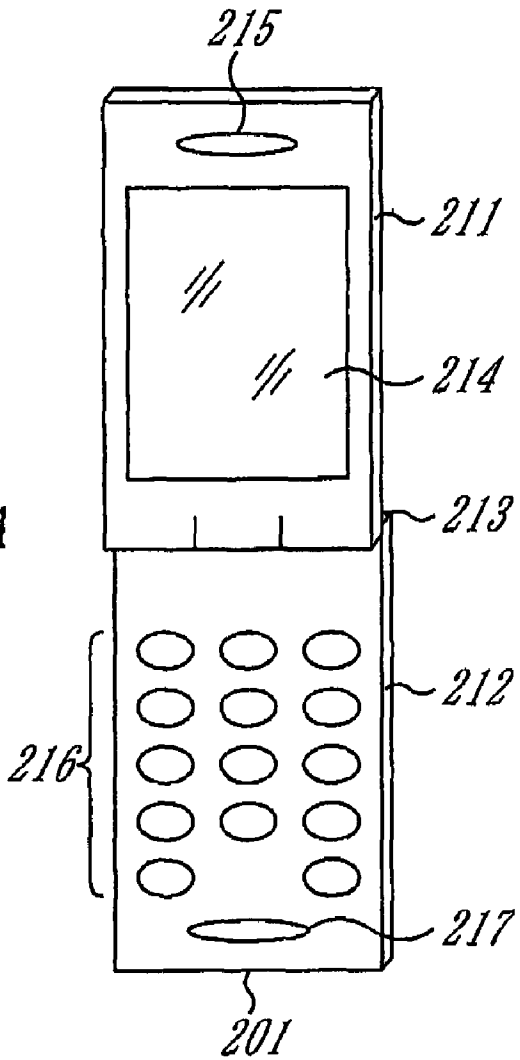
FIG. 19A is a diagram showing another external structural example of the mobile telephone using the antenna device of FIG. 4.

In FIGS. 18A and 19A, a mobile telephone 201 comprises an upper body 211 having a display 214 and a speaker 215, a lower body 212 having a manual control 216 and a microphone 217, and a hinge 213 for joining the upper body 211 and the lower body 212 to each other. Although the hinge 213 is simplified in FIGS. 18A and 19A, the upper body 211 and the lower body 212 are supported by the hinge 213 in a manner to be rotatable.

FIGS. 18B and 19B are diagrams each showing a structural example of an internal substrate in the mobile telephone 201 of FIGS. 18A and 19A. In FIGS. 18B and 19B, any component parts corresponding to those in FIG. 4 are denoted by like reference numerals or symbols, and a repeated explanation thereof will be omitted below.

In the example of FIG. 18B, a substrate 21*a* with an antenna device formed thereon is housed in the lower body 212 in such a manner that notch antennas 23 and 24 are disposed in the lowermost portion of the mobile telephone 201, and a substrate 21*b* without any antenna device is housed in the upper body 211 of the mobile telephone 201, whereby the notch antennas 23 and 24 (particularly an open end 23*a* of the notch antenna 23 and an open end 24*a* of the notch antenna 24) are positioned under the head to consequently reduce the harmful influence that may otherwise be derived from the head and exerted to the antenna characteristic.

In the example of FIG. 19B, a substrate 21*a* with an antenna device formed thereon is housed in the upper body 211 in such a manner that notch antennas 23 and 24 are disposed in the uppermost portion of the mobile telephone 201, and a substrate 21*b* without any antenna device is housed in the lower body 212 of the mobile telephone 201, hence reducing the harmful influence that may otherwise be exerted to the antenna characteristic from the user's hand which holds the mobile telephone 201.

Although not shown in particular, antenna devices may be provided in both of the upper body 211 and the lower body 212. In this case, an optimal antenna characteristic can be attained in compliance with the communication environment by selectively switching the antenna devices in the upper body 211 and the lower body 212 or by combining the signals received in the two antenna devices.

The explanation given above is concerned with a foldable type mobile telephone where the upper body 211 and the lower body 212 thereof are rotatable. However, the present invention is applicable also to a straight type mobile telephone different from such foldable type.

Figure 20C:
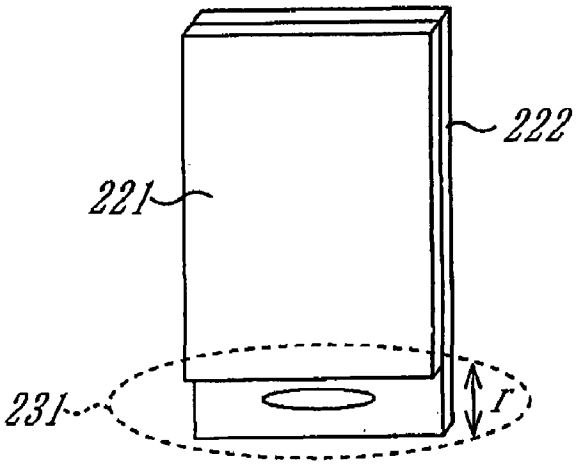
FIG. 20C is a diagram showing a further structural example in a state where the mobile telephone using the antenna device of FIG. 4 is folded up.
Figure 20B:
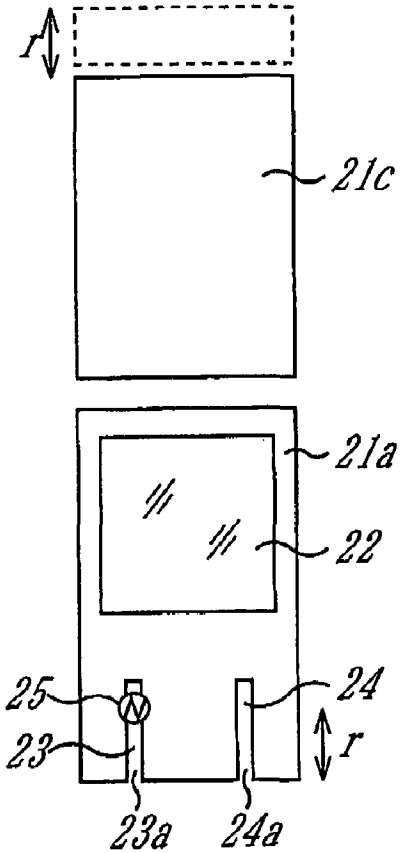
FIG. 20B is a diagram showing a further internal structural example of the mobile telephone using the antenna device of FIG. 4.
Figure 20A:
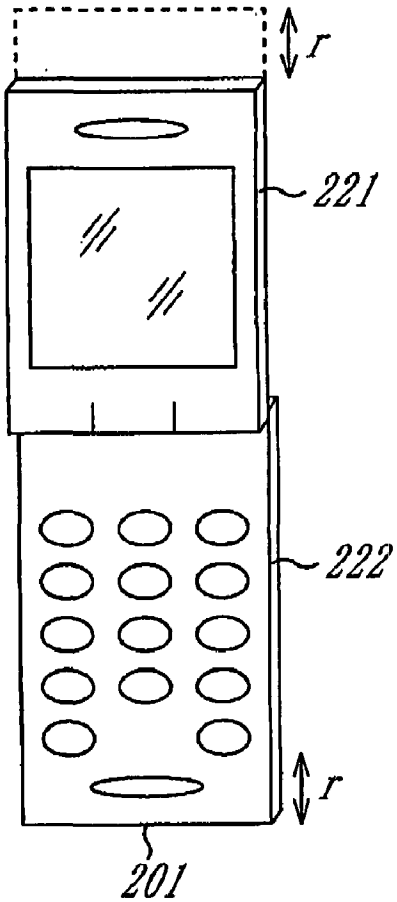
FIG. 20A is a diagram showing a further external structural example of the mobile telephone using the antenna device of FIG. 4.

FIG. 20A shows an example where the upper body 211 and the lower body 212 of the mobile telephone 201 of FIG. 18A is replaced with an upper body 221 and a lower body 222 respectively.

In FIG. 20A, the upper body 221 is shaped to be shorter than the lower body 222 by a predetermined length r, and in conformity therewith, as shown in FIG. 20B, a substrate 21*c* having no antenna device and housed in the upper body 221 is formed to be shorter by the predetermined length r than a substrate 21*a* having an antenna device formed thereon and housed in the lower body 222.

Therefore, as shown in FIG. 20C, when the upper body 211 of the mobile telephone 201 is rotated on the hinge 213 and is folded to be joined to the lower body 212, a lower portion 231 of the lower body 222 is not superposed on the upper body 221 and projects downward. Consequently, an open end 23*a* of the notch antenna 23 and an open end 24*a* of the notch antenna 24 shown in FIG. 20B are not superposed on (not opposed to) another substrate 21*c* and project downward.

As a result, particularly in a standby state where the lower body 222 and the upper body 221 are closed, it becomes possible to diminish an undesirable possibility that a wide-band characteristic fails to be realized due to the harmful influence derived from the opposed disposition of the notch antennas 23 and 24 to another substrate 21*c*.

Figure 21:
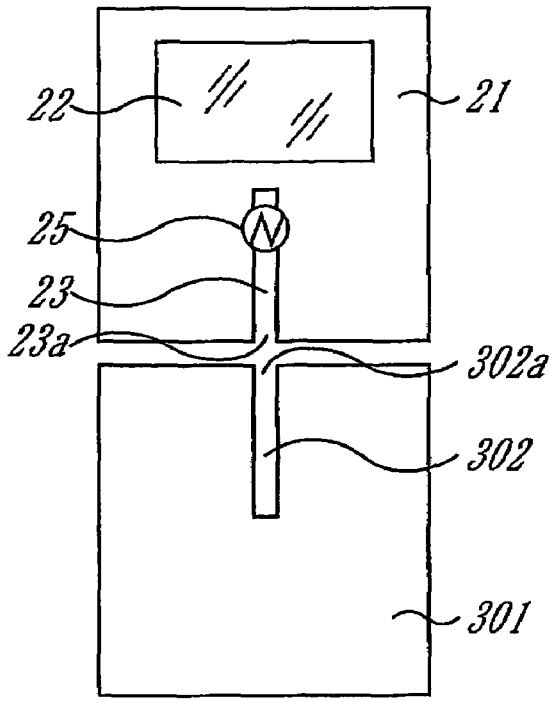
FIG. 21 is a diagram showing another structural example of the antenna device where the present invention is applied.

Referring further to FIG. 21, an explanation will be given on a structural example of another antenna device employed in a foldable type mobile telephone 201 where an upper body 211 and a lower body 212 are rotatable. In FIG. 21, any component parts corresponding to those in FIG. 4 are denoted by like reference numerals or symbols, and a repeated explanation thereof will be omitted below.

In the antenna device of FIG. 21 shown as an example, a substrate 21 is housed in an upper body 211 of a mobile telephone 201, and a substrate 301 is housed in a lower body 212 of the mobile telephone 201. In FIG. 21, the upper body 211 and the lower body 212 of the mobile telephone 201 are in an open state.

On the substrate 301, a notch antenna 302 operating through electromagnetic coupling with a notch antenna 23 is formed in a length slightly shorter than $\lambda/4$ from an open end 302*a* at one edge thereof facing to the substrate 21. Therefore, the open end 302*a* of the notch antenna 302 on the substrate 301 is disposed in the vicinity of an open end 23*a* of the notch antenna 23 on the substrate 21. These two antennas are cut in the same direction (to form parallel slits), so that the directions of the main polarization can be rendered the same (parallel).

Figure 22:
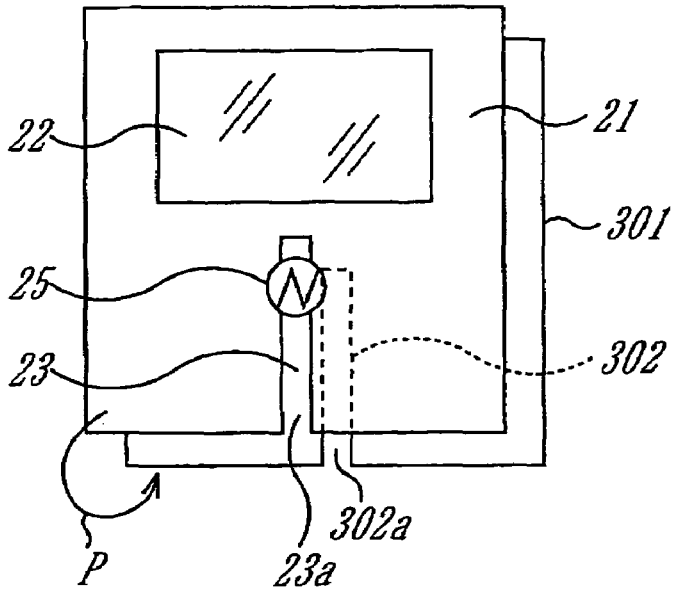
FIG. 22 is a diagram for illustrating a state where the antenna device of FIG. 21 is folded up.

FIG. 22 is a diagram showing another state where, in the mobile telephone 201 employing the antenna device of FIG. 21, the substrate 21 and the substrate 301 are rotated on the hinge 213 (FIG. 19A), and the lower body 212 housing the substrate 301 therein is joined to the -upper body 211 housing the substrate 21 in a manner to be folded back inward as indicated by an arrow P.

As shown in FIG. 22, also when the upper body 211 and the lower body 212 are folded, the open end 302*a* of the notch antenna 302 is positioned in the vicinity of the open end 23*a* of the notch antenna 23. Consequently, a wide-band characteristic can be attained even in case the mobile telephone is folded, as well as in the case where the upper and lower bodies thereof are open.

Thus, even in the notch antenna formed on the other substrate, the antenna is provided in the vicinity of the open end of the notch antenna with a feeder in such a manner as to generate the same main polarization, whereby the same advantageous effect is achievable as in the aforementioned antenna device of FIG. 16.

As described hereinabove, the antenna operating through electromagnetic coupling is provided in the vicinity of the open end of the notch antenna with a feeder so as to generate the same main polarization, hence achieving a wide-band or multi-resonance input impedance characteristic of the antenna device.

The description given above is concerned with an exemplary case of applying the present invention to a mobile telephone. However, the present invention is applicable also to some other mobile radio communication terminal having an antenna device, such as PDA (Personal Digital Assistance) or the like.

INDUSTRIAL APPLICABILITY

Thus, according to the present invention, it is possible to improve the performance of the antenna device. Moreover, the present invention ensures a stable impedance characteristic. And further according to the present invention, a wide-band characteristic can be realized.

The invention claimed is:

1. An antenna device comprising:

a first substrate independent of a radio circuit with respect to high frequencies;

a first antenna formed on said first substrate and comprising of a slit-shaped notch antenna having a feeder; and a second antenna disposed at a position other than said first substrate where said first antenna is formed, disposed in the vicinity of an open end of said first antenna in such a manner that the direction of main polarization thereof becomes coincident with that of said first antenna, and operating through electromagnetic coupling with said first antenna.

2. The antenna device according to claim 1, wherein said second antenna is a linear antenna.

3. The antenna device according to claim 1, wherein said second antenna is a notch antenna formed on a second substrate different from said first substrate where said first antenna is formed.

4. The antenna device according to claim 2, wherein said linear antenna is shaped into a straight line, zigzag, helical, meander, or loop.

5. The antenna device according to claim 3, wherein said first substrate is housed in a first body and said second substrate is housed in a second body, and said first body and said second body are foldably connected using a hinge.

* * * * *